US006475085B2

(12) United States Patent
Moody

(10) Patent No.: US 6,475,085 B2
(45) **Date of Patent: *Nov. 5, 2002**

(54) NUMERICAL TOTAL HIGH/LOW LOTTERY GAME

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

This patent is subject to a terminal disclaimer.

(21) Appl. No.: 09/758,413

(22) Filed: Jan. 10, 2001

(65) Prior Publication Data

US 2001/0003098 A1 Jun. 7, 2001

Related U.S. Application Data

(63) Continuation-in-part of application No. 09/441,412, filed on Nov. 16, 1999.

(51) Int. Cl.[7] ..... A63F 5/00

(52) U.S. Cl. ..... 463/17; 463/16; 463/18; 463/19; 273/19; 273/269; 273/237; 273/139

(58) Field of Search ..... 463/16, 17, 18, 463/19; 273/269, 138.1, 139

(56) References Cited

U.S. PATENT DOCUMENTS

| | | | | | |
|---|---|---|---|---|---|
| 5,106,089 | A | * | 4/1992 | Wood | 273/139 |
| 5,651,735 | A | * | 7/1997 | Baba | 463/18 |
| 5,935,001 | A | * | 8/1999 | Baba | 463/18 |

* cited by examiner

*Primary Examiner*—Jessica Harrison
*Assistant Examiner*—Yveste Cherubin
(74) *Attorney, Agent, or Firm*—John Edward Roethel

(57) ABSTRACT

A player selects whether the numerical total of the numbers selected during a lottery game will be high or low, or either high or low. When the winning lottery numbers are selected, they are also totaled and a numerical sum of the selected lottery numbers is determined. The numerical total is designated as "high", "low" or "middle" based on pre-established criteria and winning high/low selections are paid. A separate wager may be required for the player to be eligible for this high/low feature of the lottery game.

10 Claims, 1 Drawing Sheet

NUMERICAL TOTAL HIGH/LOW LOTTERY GAME

CROSS-REFERENCE TO RELATED APPLICATION

This application is a Continuation-in-Part of application Ser. No. 09/441,412, entitled "Numerical Total Keno Game", filed Nov. 16, 1999, now pending. The disclosure of this earlier application is incorporated herein by this reference, with the earlier application being commonly owned with this application.

This invention relates primarily to a live or electronic video lottery game, and more particularly to a live or electronic video lottery game in which the player wagers on whether the final numerical total of the lottery numbers selected will be either a high total or a low total or both a high total or a low total.

BACKGROUND OF THE INVENTION

Many states offer lottery games. While these state lottery games have taken many forms, the traditional lottery game involves a player selecting six numbers from a pool of fifty total numbers. After the player makes his selection, the operator of the lottery selects six numbers from the total pool of numbers. The player wins or loses based on the quantity of matches between the numbers selected by the player and the numbers selected by the operator. The player can win very large payouts for correctly picking all six winning lottery numbers.

Other lottery schemes involve picking more or less than six numbers and the size of the total pool of numbers can be more or less than fifty numbers. The drawing of the winning numbers can be done on a periodic basis, such as once a day or once a week. Alternatively, some lottery states offer instant lottery games in which the player picks three or four numbers and, using a computer with a random number generator, a quick pick of winning numbers is done concurrently with the player's number selection and the player knows immediately if he has won or lost.

The drawback to the conventional lottery game is that the player can only win if he matches the numbers selected by the lottery operator. The mathematical probability of the player winning is quite low and most plays are losing plays (which apparently is the appeal of lotteries to state governments which typically set the payouts so that 50% or more of the money wagered by the players is kept for the state treasury).

U.S. Pat. No. 5,106,089 (Wood) (the disclosure of which is incorporated herein) describes a lottery summing game in which the numerical total of the numbers drawn in a lottery game is summed and the player wagers on what the numerical total will be. The player is provided with a wagering slip upon which the player marks which numerical totals the player thinks the selected lottery numbers will total. The wagering slip shows various winning number groups from which the player may select one, some or all of the wagering number groups with each wagering number group requiring a separate wager. Each wagering number group has its associated payout odds.

As disclosed in this patent, the pool of lottery numbers range from 0 to 9 and there are three groups of lottery numbers, with one number being drawn from each group. The three lottery numbers are drawn and the numerical value of the drawn lottery numbers is totaled. This final sum total is then compared to the player slips and any player who has selected the correct final sum total is a winner. A winning player is awarded odds based on the amount of his wager depending on what the final sum total is. The. odds range from 250-for-1 down to 1.75-for-1. Other betting possibilities are disclosed, such as wagering that all three numbers are odd; all three numbers are even; two numbers are odd and one number is even; or two numbers are even and one number is odd.

The drawback of this method of play in the Wood '089 patent is that the player is limited to a very narrow range of possible winning combinations and the pool of numbers from which the numbers are drawn is quite small.

It is an object of the present invention to provide an improved lottery game that offers the player the opportunity to win large payouts depending on what the final numerical total of the selected lottery numbers is when all of the selected lottery numbers are added up.

It is a feature of the present invention to provide that a player may select that the total of the selected lottery numbers may be a high total or a low total, or either a high total or a low total. If the player has correctly selected high or low, the player receives a payout. This feature can be incorporated into a conventional lottery game and the player can be awarded this additional payout in conjunction with any normal payouts that the player may win during the conventional lottery game. The player may engage in this high/low sum feature of a lottery game without having to make an additional wager, aside from the wager the player makes to participate in the conventional lottery game. Alternatively, the player can be required to make a second wager to be eligible for this high/low sum feature in addition to the conventional first wager to participate in the lottery game. Still as another alternative, the player may simply wager on the high/low game and not play in the regular lottery game.

It is an advantage of the present invention that a lottery game will be enhanced by this new and exciting feature and that the player can win a payout based on whether the numerical total of the selected lottery numbers is high or low. This will increase participation in the lottery games offered by the lottery operator.

Other objects, features and advantages of the present invention will become apparent from a consideration of the following detailed description.

SUMMARY OF THE INVENTION

A player selects whether the numerical total of the numbers selected during a lottery game will be high or low, or either high or low. When the winning lottery numbers are selected, they are also totaled and a numerical sum of the selected lottery numbers is determined. The numerical total is designated as "high", "low" or "middle" based or pre-established criteria and winning high/low selections are paid. A separate wager may be required for the player to be eligible for this high/low feature of the lottery game.

The player may receive a fixed amount as the award for correctly selecting whether the numerical total of the winning lottery numbers is high or low. Alternatively, the player may receive an award from a sliding scale of awards based on the actual numerical total of the winning lottery numbers.

DETAILED DESCRIPTION OF THE PREFERRED EMBODIMENTS

Figure 1:
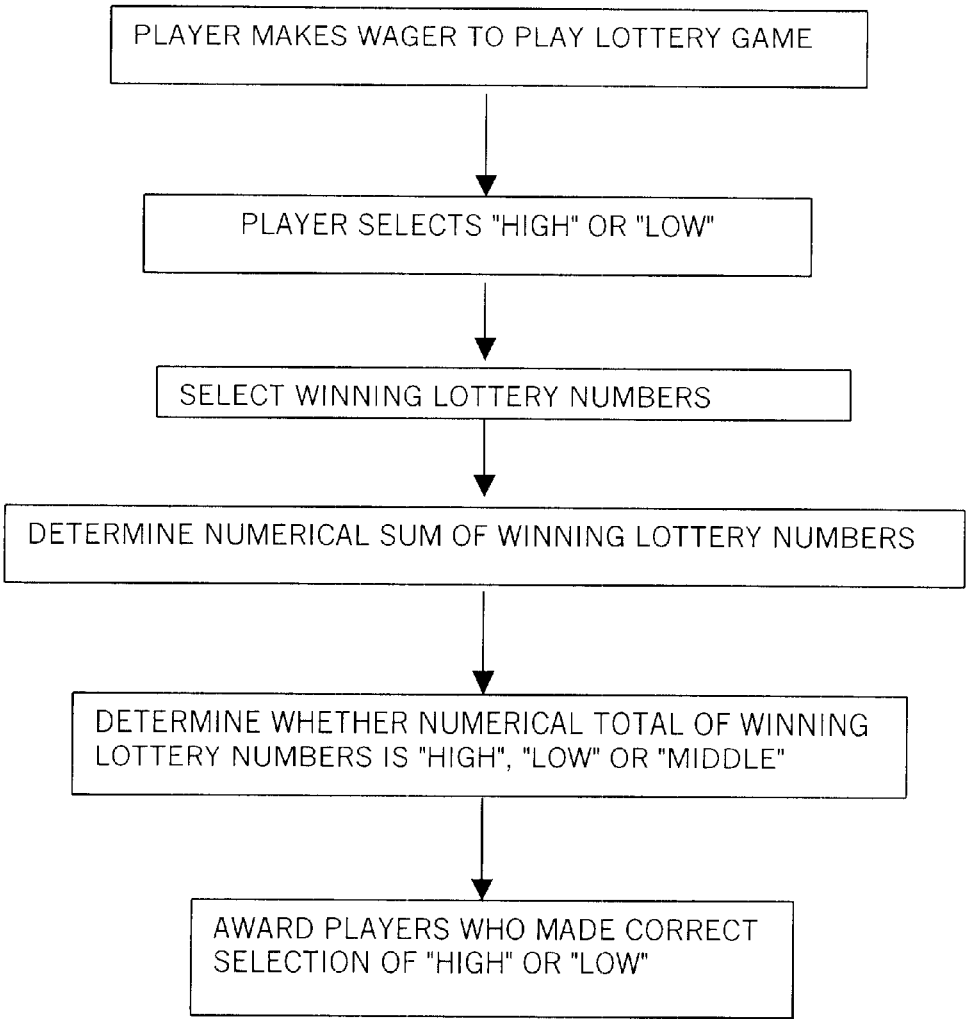
FIG. 1 shows a flow chart of the steps of the present invention.

The method of the present. invention is played using either a live lottery game format or using an electronic lottery gaming machine. The description that follows refers to a live lottery game format, but the same principles of the present invention can be easily adapted to an electronic lottery gaming machine.

In accordance with the method of the present invention, a player participates in a conventional lottery game. The player purchases a lottery ticket and selects the required amount of numbers, say six, from the overall total number pool, say fifty numbers designated as the numbers one through fifty. The player's numbers are marked on his lottery ticket and the lottery ticket is given to the player.

The player also selects "High" or "Low", meaning whether the numerical total of the winning lottery numbers when added together will fall into a "high" grouping or a "low" grouping.

At the appointed time, say 7:00 PM at night, the winning lottery numbers for that day are selected by the operator of the lottery. Alternatively, the winning lottery numbers can be selected once a week, once a month or once each hour or on whatever periodic basis is desired by the lottery operator. The player compares the player's selected numbers to the winning lottery numbers and the player determines if he has a winning occurrence in the conventional lottery game. The player receives an award, typically a monetary payout (but which could take the form of other consideration such as a car, a boat, a vacation trip or some other valuable item or prize), based on the number of matches the player has achieved between the player's numbers and the selected winning lottery numbers. Typically, the player wins a small award for matching three numbers and a very large payout for matching all of the numbers, usually six numbers. If the player matches two or fewer numbers, the player normally has a losing play.

The numerical total of the winning lottery numbers is also calculated and the player determines whether he has a winning occurrence in the High/Low game. If the player has achieved a winning occurrence, the player receives an award, which is normally a monetary award (but which could be another valuable item or prize).

Since games of chance have both winning occurrences and losing occurrences, the method of the present invention will have a group of numerical totals that are designated "high" totals, a group of numerical totals that are designated as "low" totals and a group of numerical totals that are designated as "middle" totals (i.e. numerical totals that are neither "high" or "low").

The determination of which numerical totals are "high" totals, which numerical totals are "low" totals and which numerical totals are "middle" totals is based on the mathematical occurrences related to choosing six numbers from a group of fifty numbers and summing the value of the six numbers chosen. The lowest possible numerical total is 21 (the winning numbers being 1, 2, 3, 4, 5 and 6). The highest possible numerical total is 285 (the winning numbers being 45, 46, 47, 48, 49 and 50).

Any suitable grouping of "low" number totals can be selected based on the probability of winning "low" total occurrences the lottery operator wishes to provide. Similarly, any suitable grouping of "high" number totals can be selected based on the probability of winning "high" total occurrences the lottery operator wishes to provide. The remaining totals that are designated as neither "low" totals nor "high" totals are the "middle" totals. Any numerical total that falls in the "high" totals group is a winning play for those players who have wagered on the "high" total and a losing play for those players who have wagered on the "low" total; any numerical total that falls in the "low" totals group is a winning play for those players who have wagered on the "low" totals group and a losing play for those players who have wagered on the "high" totals group; and any numerical total that falls in the "middle" totals group is a losing play for all players.

For example, the numerical totals falling from 21 through 100, inclusive, can be designated as "low" number totals. The numerical totals falling from 206 through 285, inclusive, can be designated as "high" number totals. The "middle" number totals would then be the numerical totals falling from 101 through 205, inclusive.

If a player chooses the "low" total and the numerical sum of the winning lottery numbers falls in the "low" group, the player wins an award. Any suitable amount may be awarded, for example, $1000 if the player is playing a $1 lottery ticket.

If a player chooses the "high" total and the numerical sum of the winning lottery numbers falls in the "high" group, the player wins an award. Any suitable amount may be awarded, for example, $1000 if the player is playing a $1 lottery ticket.

If the method of play allows the player to choose either "high" or "low", then a winning occurrence would pay the player a smaller award, say $500 if the player is playing a $1 lottery ticket.

Alternatively, the awards may be based on a sliding scale based on the actual numerical total of the winning lottery numbers. The "low" numerical totals that are winning occurrences may be broken into payout groups. For example, if the numerical "low" total is from 51–100, the award to the player could be a free lottery ticket in the next or a subsequent game. If the numerical "low" total is from 31–50, the player could be awarded $500. Then, if the numerical "low" total is from 21–30, the player could be awarded $5000 or even higher.

Similarly, the "high" numerical totals that are winning occurrences may also be broken into payout groups. For example, if the numerical "high" total is from 206–255, the award to the player could be a free lottery ticket in the next or a subsequent game. If the numerical "high" total is from 256–275, the player could be awarded $500. Then, if the numerical "high" total is from 276–285, the player could be awarded $5000 or even higher.

Any suitable groupings can be used and the foregoing example should be considered as illustrative, rather than limiting.

The method of the present invention may also be played as a stand alone game separate from player participation in a regular lottery game. The player would make a suitable wager on "high", "low" or either "high" or "low". The numerical total of the winning lottery numbers would be calculated and the resulting numerical total would be designated as either a "high" numerical total, a "low" numerical total or a "middle" numerical total. Winning wagers would be paid and losing wagers collected by the lottery operator. Since the players who are playing this "high/low" game would be making separate wagers to participate in this game, the size of the payouts and the range of the various numerical totals could be varied depending on the game return desired to be offered by the lottery operator.

The method of the present invention has been described in the context of the conventional lottery format which uses a total number pool of fifty numbers, from which six numbers are drawn each game. However, the present invention can also be applied to a lottery-type game in which the size of the complete pool can be more or less than fifty numbers and in which the amount of numbers drawn can be more or less than six numbers. If the size of the complete pool is changed and/or the amount of numbers drawn is changed, then the groups of "high", "low" and "middle" number totals and the payouts will also be changed to reflect the varying mathematical odds which are based on the size of the complete pool and the amount of numbers drawn.

As described above, the awards may be based on a sliding scale based on the actual numerical total of the winning lottery numbers. Because the wagers made by the players in this version of the present invention can be used to fund these payouts, the payouts can be quite large and could even be in the million dollar range.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a lottery game in which a player purchases a lottery ticket to play a conventional lottery game and to play a "high/low" feature in conjunction with the conventional lottery game, comprising:

a) designating a first group of numerical totals as "high" number totals, designating a second group of numerical totals as "low" number totals and designating a third group of numerical totals as "middle" number totals;

b) the player selecting a predetermined amount of numbers as the player's lottery numbers;

c) the player also selecting either the "high" number totals, the "low" number totals or both the "high" and "low" number totals;

d) randomly selecting a predetermined amount of winning numbers from a pool of numbers;

e) determining the amount of matches between the player's numbers and the winning numbers and providing the player with an award if the player achieves at least a minimum amount of matches;

f) adding up the numerical values of the winning numbers to determine a numerical total;

g) determining whether the numerical total of the winning numbers is a "high" number total, a "low" number total or a "middle" number total; and h) if the numerical total is a "high" number total and the player has selected either the "high" number totals or both the "high" and "low" number totals, providing the player with an award; or if the numerical total is a "low" number total and the player has selected either the "low" number totals or both the "high" and "low" number totals, providing the player with an award; or if the numerical total is a "middle" number total, not providing the player with an award.

2. The method of claim 1 in which the "high" number totals are from 206–285, the "low" number totals are from 21–100 and the "middle" number totals are from 101–205.

3. The method of claim 2 in which the "high" number totals are further broken into at least two groupings and the award made to the player is based on the "high" number groupings in which the numerical total of the winning numbers falls.

4. The method of claim 2 in which the "low" number totals are further broken into at least two groupings and the award made to the player is based on the "low" number groupings in which the numerical total of the winning numbers falls.

5. The method of claim 1 in which the predetermined amount of player numbers selected is six, the amount of numbers in the pool of numbers is fifty and the amount of winning numbers selected is six.

6. A method of playing a lottery game in which a player makes a wager to play a "high/low" feature in conjunction with the conventional lottery game, comprising:

a) designating a first group of numerical totals as "high" number totals, designating a second group of numerical totals as "low" number totals and designating a third group of numerical totals as "middle" number totals;

b) the player selecting a predetermined amount of numbers as the player's lottery numbers and the player also selecting either the "high" number totals, the "low" number totals or both the "high" and "low" number totals;

c) randomly selecting a predetermined amount of winning numbers from a pool of numbers;

d) adding up the numerical values of the winning numbers to determine a numerical total;

e) determining whether the numerical total of the winning numbers is a "high" number total, a "low" number total or a "middle" number total; and f) if the numerical total is a "high" number total and the player has selected either the "high" number totals or both the "high" and "low" number totals, providing the player with an award; or if the numerical total is a "low" number total and the player has selected either the "low" number totals or both the "high" and "low" number totals, providing the player with an award; or if the numerical total is a "middle" number total, not providing the player with an award.

7. The method of claim 6 in which the "high" number totals are from 206–285, the "low" number totals are from 21–100 and the "middle" number totals are from 101–205.

8. The method of claim 7 in which the "high" number totals are further broken into at least two groupings and the award made to the player is based on the "high" number groupings in which the numerical total of the winning numbers falls.

9. The method of claim 7 in which the "low" number totals are further broken into at least two groupings and the award made to the player is based on the "low" number groupings in which the numerical total of the winning numbers falls.

10. The method of claim 6 in which the predetermined amount of player numbers selected is six, the amount of numbers in the pool of numbers is fifty and the amount of winning numbers selected is six.

* * * * *